US005343576A

United States Patent [19]

Dannenberg et al.

[11] Patent Number: 5,343,576

[45] Date of Patent: Sep. 6, 1994

[54] COMBINED BATHING SEAT AND BACK REST MEMBER

[75] Inventors: Todd D. Dannenberg; Thomas C. Jorsch, both of Sheboygan; Peter W. Swart, Oostburg; Larry H. Panzer, Sheboygan Falls, all of Wis.

[73] Assignee: Kohler Co., Kohler, Wis.

[21] Appl. No.: 78,800

[22] Filed: Jun. 16, 1993

Related U.S. Application Data

[63] Continuation of Ser. No. 825,432, Jan. 21, 1992, abandoned, which is a continuation-in-part of Ser. No. 717,230, Jun. 18, 1991, abandoned.

[51] Int. Cl.[5] ..... A47K 3/022

[52] U.S. Cl. ..... 4/590; 4/579

[58] Field of Search ..... 4/538, 546–548, 4/559, 571.1–575.1, 578.1, 579, 589, 590

[56] References Cited

U.S. PATENT DOCUMENTS

| | | | |
|---|---|---|---|
| 1,597,922 | 8/1926 | Osborn . | |
| 2,714,725 | 8/1955 | Boone | 4/590 X |
| 2,813,276 | 11/1957 | Lanza | 4/579 |
| 2,899,688 | 8/1959 | Hopkins | 4/185 |
| 3,900,902 | 8/1975 | Jarosinski | 4/590 X |

FOREIGN PATENT DOCUMENTS

| | | | |
|---|---|---|---|
| 2307509 | 11/1976 | France | 4/579 |
| 1212343 | 11/1970 | United Kingdom | 4/589 |

OTHER PUBLICATIONS

A page from a 1989 Jacob Delafon Catalog entitled "Baignoires Acrylique".

Page 7-14j of the 1987 Kohler Co. "K-400 Catalog" showing the Freewill TM Shower Cove.

*Primary Examiner*—Charles E. Phillips

*Attorney, Agent, or Firm*—Quarles & Brady

[57] ABSTRACT

A combined seat and back rest assembly for a bathing enclosure wherein a combined seat and back rest member is hingedly positioned in the enclosure so that it is contained within the enclosure when the seat and back rest member is in a seating position. In a preferred manner, there is a recess in a wall of the enclosure and the hinges for connecting the seat and back rest member are located therein along with the seat and back rest member when in the back rest position. Also preferably, there is a spring biased hinge to provide positive retention of the seat and back rest member in the seating or back rest position. The seat and back rest assembly is particularly suited for a bathing enclosure with an entrance door.

8 Claims, 5 Drawing Sheets

FIG. 4
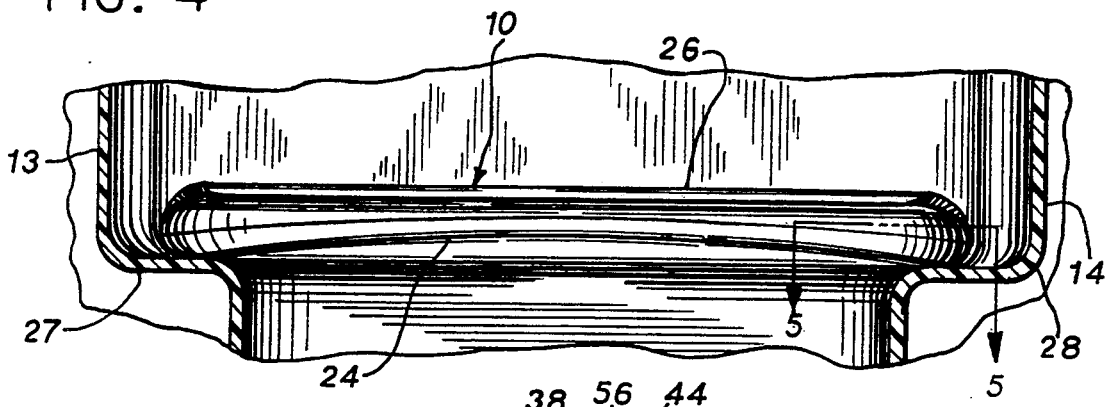
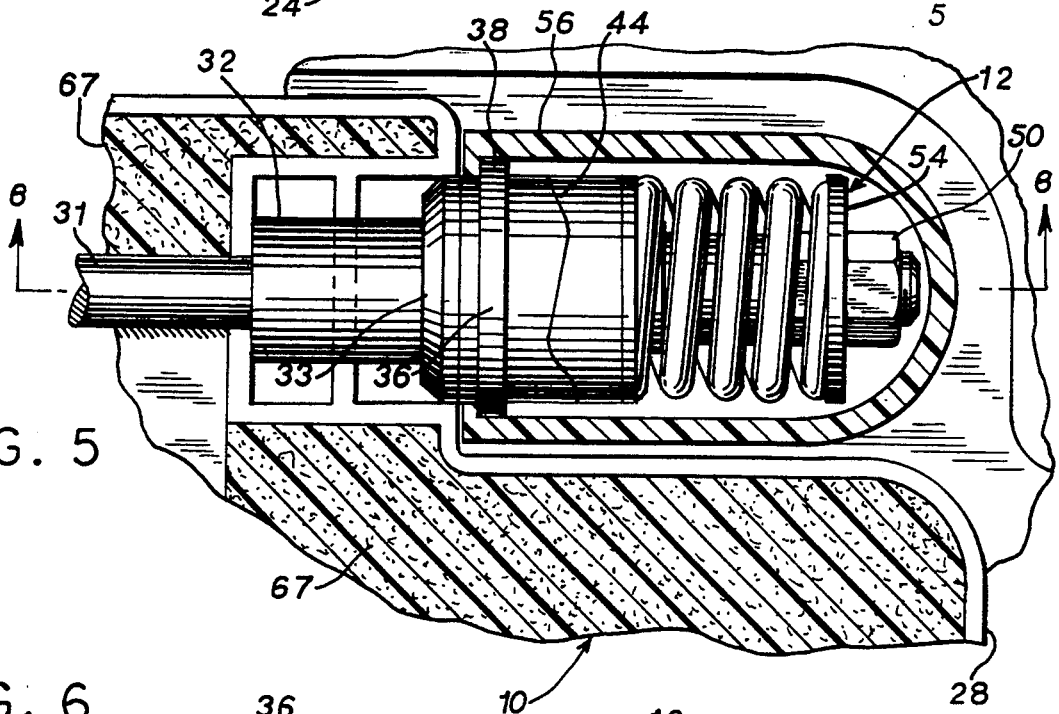
FIG. 5
FIG. 6
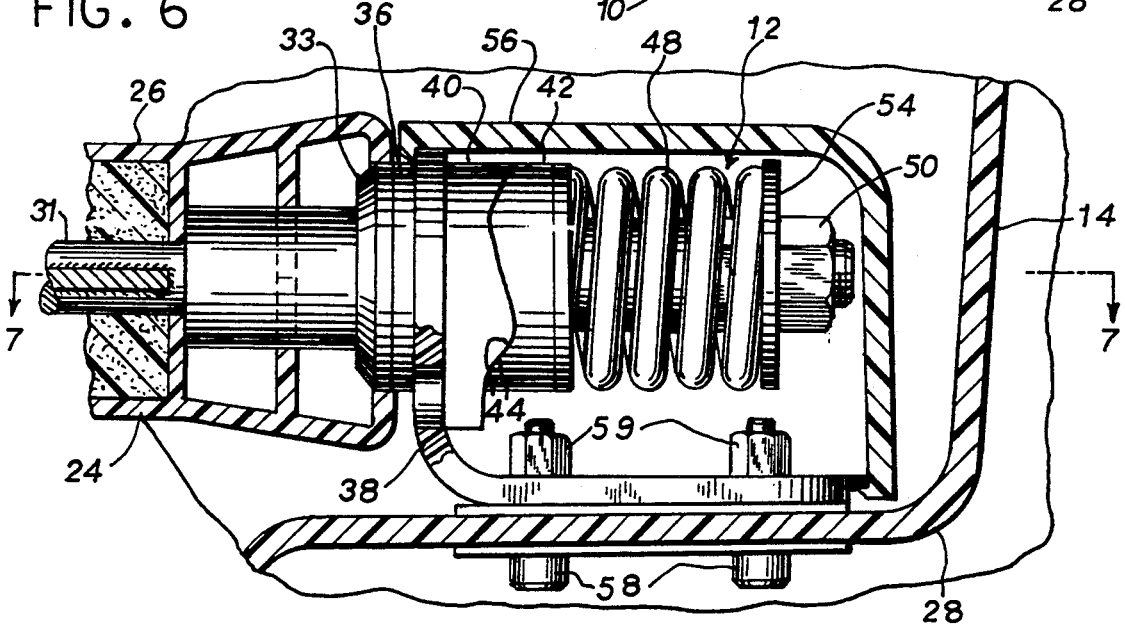

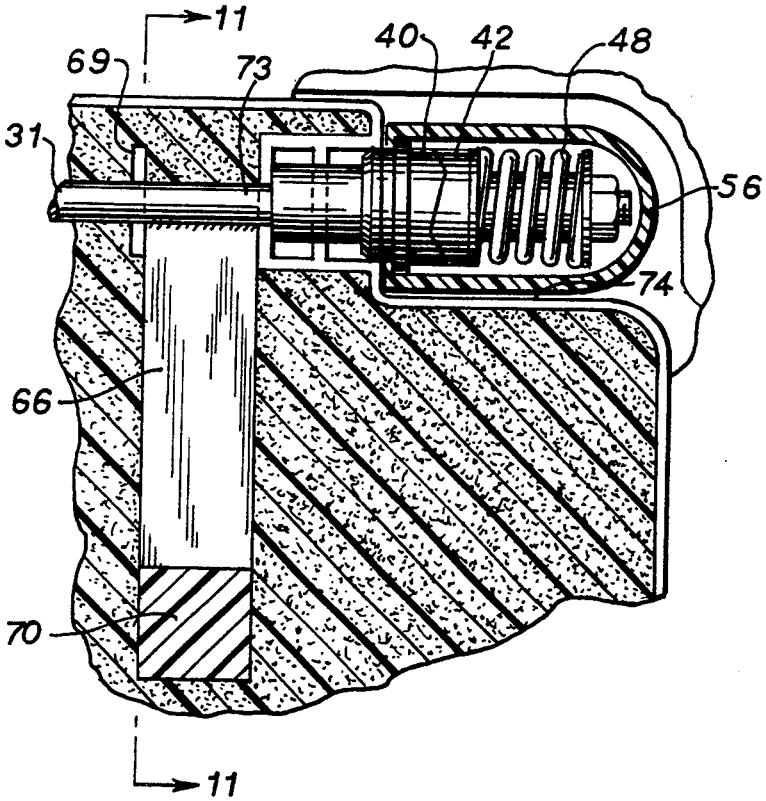
FIG. 10
FIG. 11
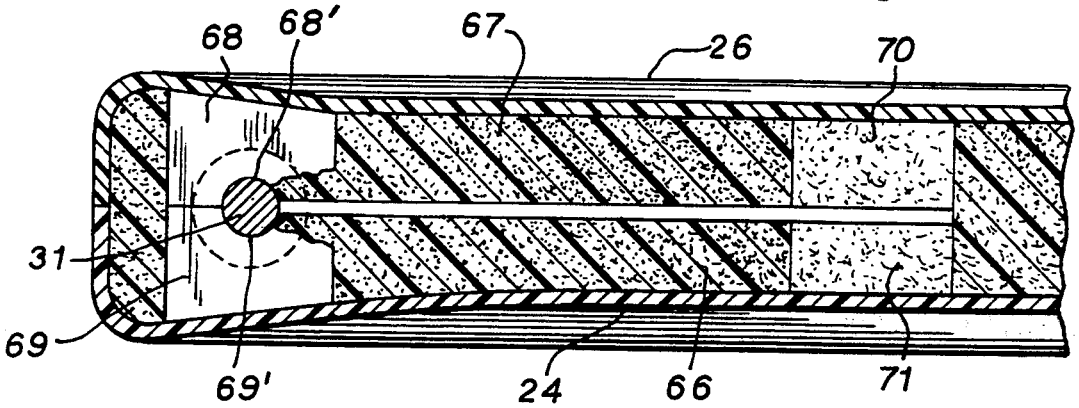
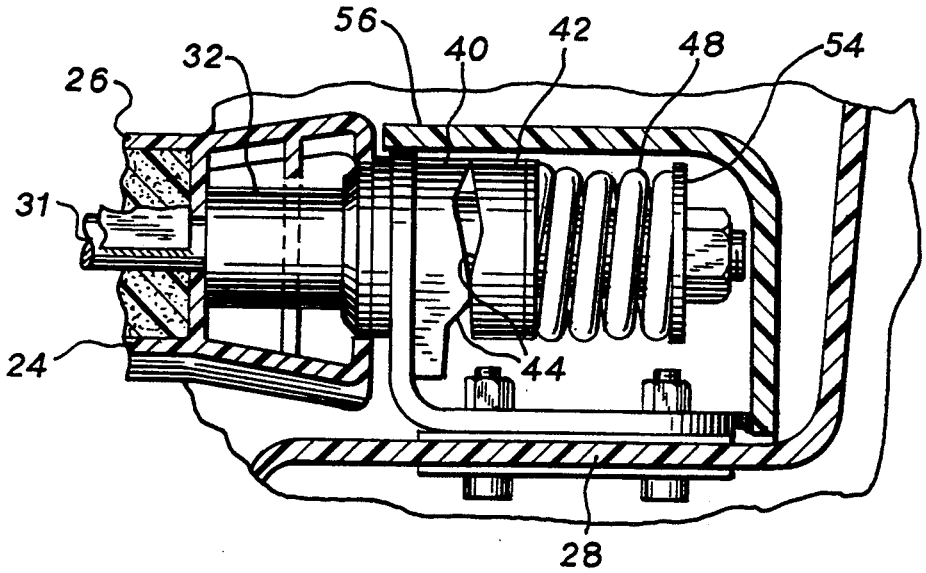
FIG. 12

FIG. 13
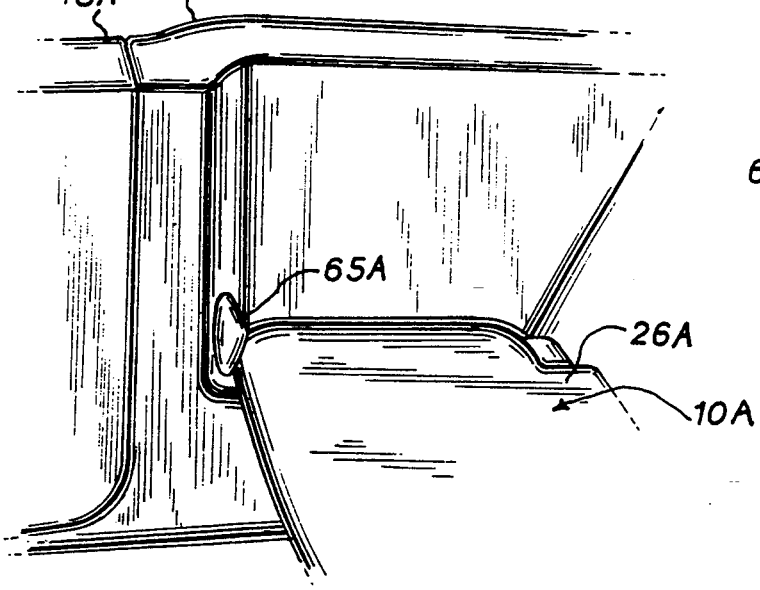
FIG. 16
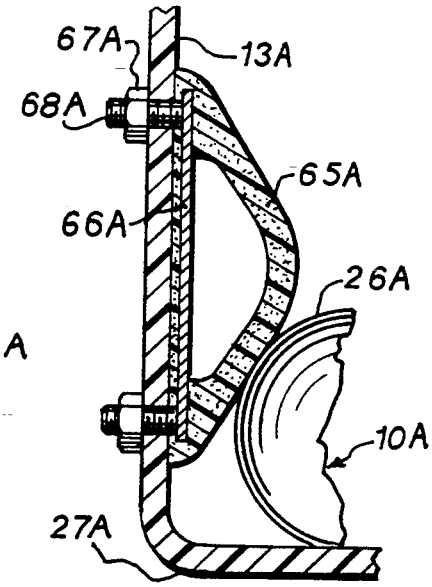
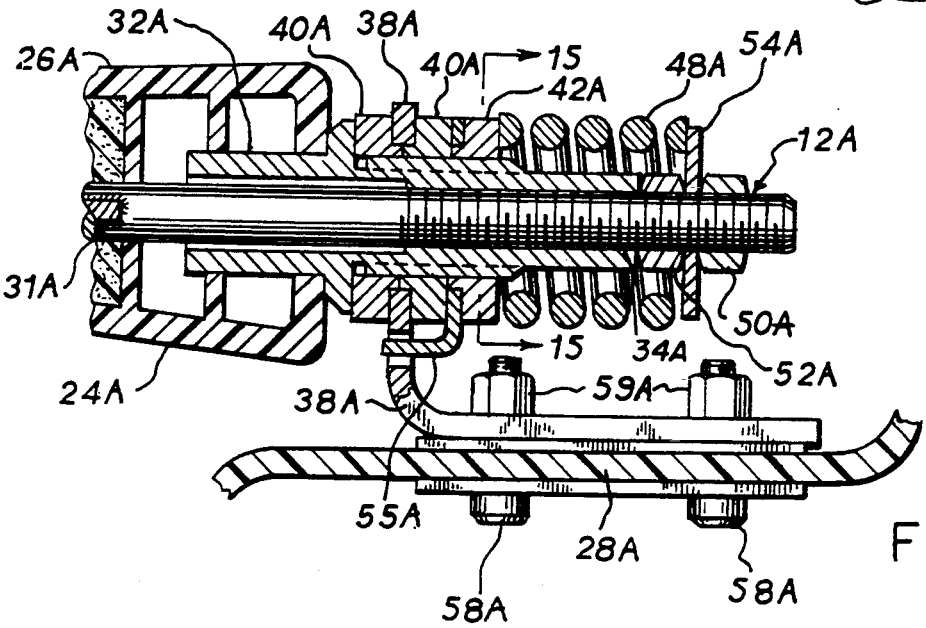
FIG. 14
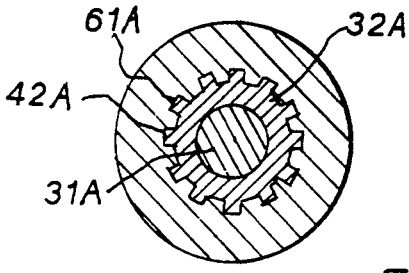
FIG. 15

COMBINED BATHING SEAT AND BACK REST MEMBER

This application is a continuation of application Ser. No. 07/825,432, filed Jan. 21, 1992 which is a continuation-in-part of application Ser. No. 07/717,230 filed Jun. 18, 1991, both now abandoned.

BACKGROUND OF THE INVENTION

1. Field of the Invention

This invention relates to seats for bathing enclosures wherein the seat can also serve as a back rest. It also relates to a hinge assembly for retaining and moving a combined seat or back rest.

2. Description of the Prior Art

Walk-in bathing enclosures are becoming more in demand as bathing facilities. These bathing enclosures have doors in a side wall to provide easy access. However, once a person such as an elderly or handicapped person enters the enclosure, there is a problem concerning sitting down on the tub floor which is at a low level. There is therefore a need to provide a seat member which is positioned well below the top of the bathing enclosure (to permit immersion of the lower torso) when a bather is seated on the seat.

In some situations, those without handicaps also wish to use these tubs (e.g. at the home of an elderly couple, one of which is handicapped; the other of which is not). The user who is not handicapped often wants to sit on the tub floor for maximum immersion. However, the existence of a non-movable seat will prevent this.

In U.S. Pat. Nos. 1,597,922 and 2,899,688, there are shown combined tub seat and back rest members in conjunction with bathing facilities. The seats pivot out of the way when not in use. However, they are not positioned deep into the tub portion and thus fail to afford enough exposure to the water. The art also tried using totally removable shelves insertable in the tub. However, removal of the shelves was awkward for the handicapped, and when removed, storage of the shelves was a problem. Also, the seats are not securely retained when in the up position and thus may fall. There was, therefore, a need for a tub seat that could support a user from deep inside the tub, but could readily be moved out of the way so as not to limit use of the tub by a non-handicapped user; and which had secured positions in each selected position.

SUMMARY OF THE INVENTION

In one form, the invention provides a combined seat and back rest assembly for a tub having an enclosure defined by side walls, a bottom wall, and an upwardly open interior cavity. The assembly includes a combined seat and back rest shelf which is pivotably mounted in the cavity adjacent one end of the cavity so that a seating surface of the combined seat and back rest shelf is contained within the cavity when the combined seat and back rest shelf is in a first position so as to form a seat.

Hinging means mounts the seat and back rest shelf to at least one side wall. The hinging means is operatively connected to permit pivotal movement of the combined seat and back rest shelf from the first position to a second position where the combined seat and back rest shelf provides a back rest.

In a preferred form, at least half of a back rest surface of the combined seat and back rest shelf is contained within the cavity when the combined seat and back rest shelf is in the second position.

In another embodiment, there is a recessed portion in a side wall near the end of the cavity to receive the shelf when the shelf is in the second position, so as to provide a generally smooth back rest surface from the tub bottom up along the shelf.

In another embodiment, the hinging means is constructed and arranged to provide resistance against downward pivoting of the shelf when it is in the second position.

In another embodiment, a wedge member and a frictional, spring tensioned hinging means provides resistance against upward pivoting of the shelf when it is in the first position.

It is therefore a principal object of the invention to provide a combined seat and back rest assembly for a bathing structure which affords maximum exposure to water for a bather when in the seating position.

It is another object of the invention to provide a combined seat and back rest assembly of the foregoing type which affords maximum comfort to the bather.

It is another object of the invention to provide a combined seat and back rest assembly wherein the seat and back rest assembly is positively positioned in a seating or back rest position.

It is another object of the invention to provide a combined seat and back rest assembly of the foregoing type which can be employed in a walk-in type bathing enclosure.

The foregoing and other objects and advantages of the invention will appear in the following detailed description. In the description, reference is made to the accompanying drawings which show, by way of illustration and not limitation, preferred embodiments of the invention.

DESCRIPTION OF THE DRAWINGS

FIG. 4 is a partial, vertical cross sectional view illustrating the combined seat and back rest member in a supported seat position;

FIG. 5 is an enlarged top plan view, partially in horizontal section, illustrating the hinging means for the combined seat and back rest shelf, with the shelf shown with the seat position;

FIG. 6 is an enlarged side elevational view, partially in vertical section, illustrating the hinging means shown in FIG. 5;

FIG. 10 is a partial, horizontal cross sectional view illustrating the connection of the hinging means to the combined seat and back rest member;

FIG. 11 is a sectional view taken along line 11—11 of FIG. 10;

FIG. 12 is a view similar to FIGS. 5 and 6 illustrating the hinging means in an intermediate position with respect to the positioning of the combined seat and back rest shelf;

FIG. 13 is a partial perspective view of an alternative embodiment of the tub showing the shelf in a lowered, seat position;

FIG. 14 is an enlarged view in vertical section illustrating the hinging means for shelf shown in FIG. 13;

FIG. 15 is a sectional view taken on line 15—15 of FIG. 14; and

FIG. 16 is an enlarged side elevational view, partially in vertical section, illustrating a wedging of the shelf shown in FIG. 13.

DETAILED DESCRIPTION OF THE PREFERRED EMBODIMENTS

Figure 1:
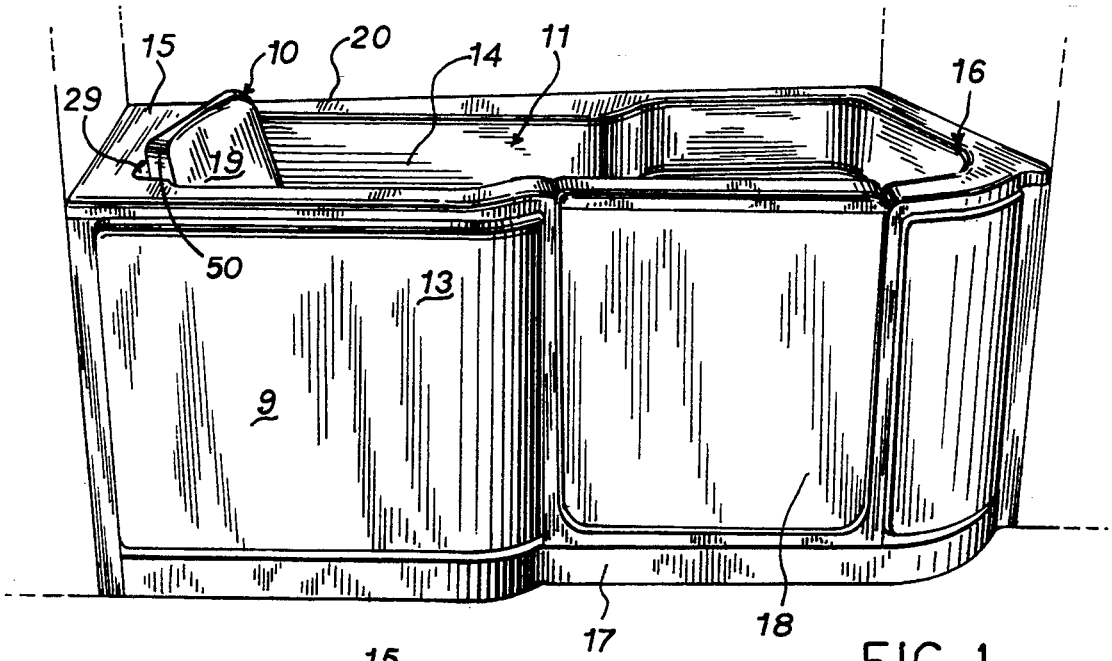
FIG. 1 is a front perspective view showing a tub in which the combined seat and back rest shelf is located.
Figure 2:
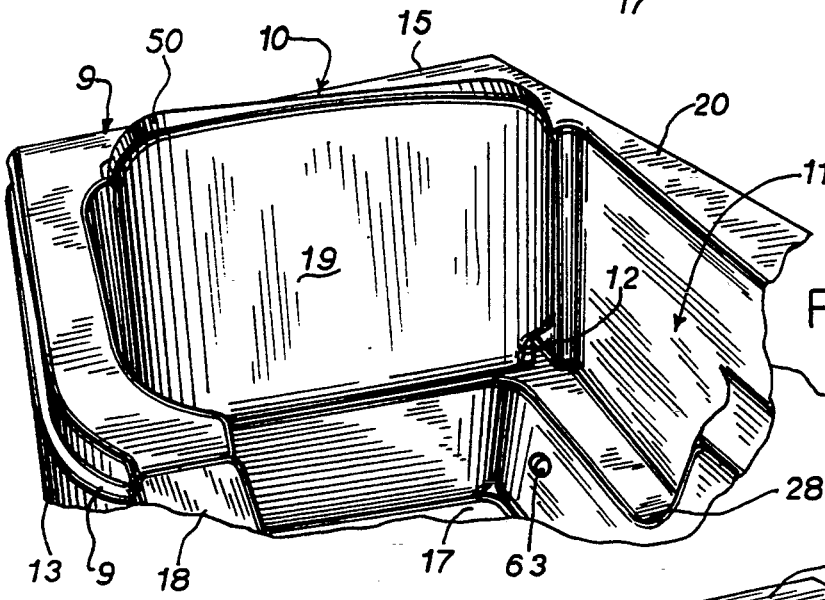
FIG. 2 is a partial perspective view of the tub showing the shelf in a raised, back rest position.
Figure 3:
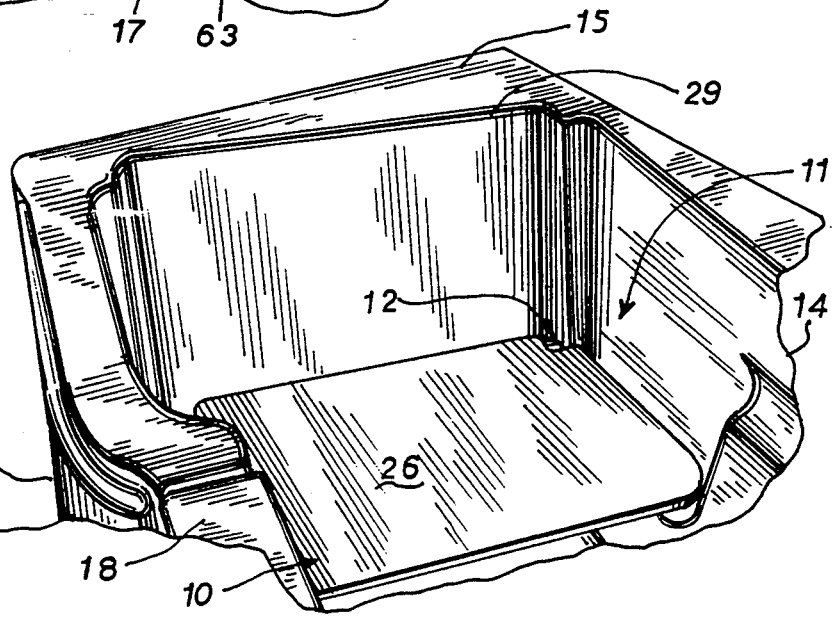
FIG. 3 is a view similar to FIG. 2, but showing the shelf in a seat position.
Figure 7:
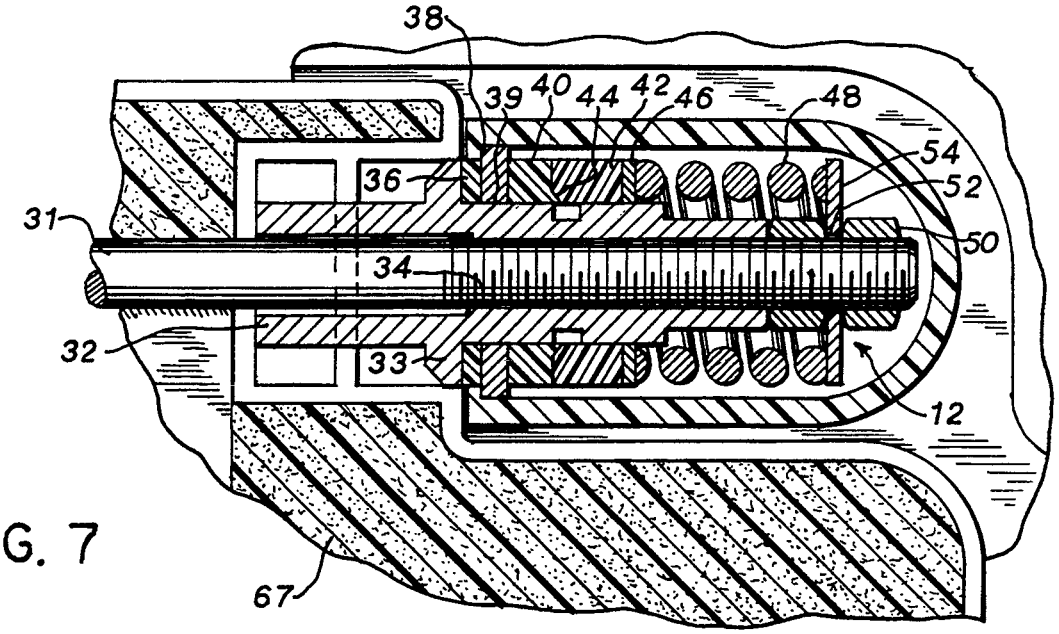
FIG. 7 is a sectional view taken along line 7—7 of FIG. 6.
Figure 8:
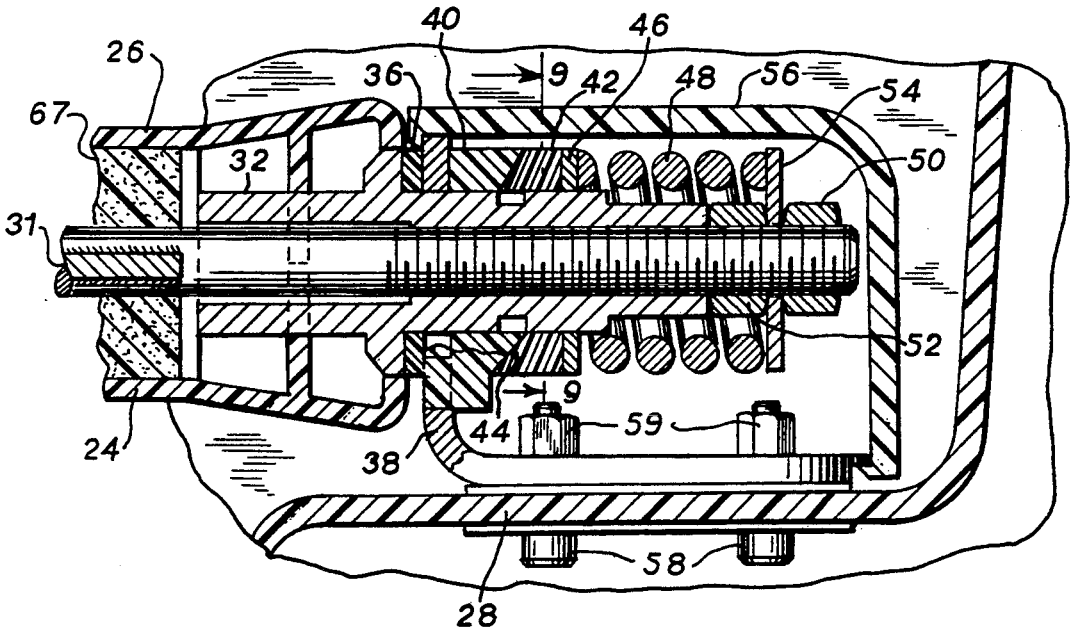
FIG. 8 is a sectional view taken along line 8—8 of FIG. 5.

Referring to FIGS. 1, 2 and 3, there is a tub 9. It is provided with a combined seat and back rest shelf generally 10. The tub has a cavity 11 defined by the usual side walls such as front wall 13, rear wall 14, and end walls 15 and 16, as well as bottom wall 17. The side wall is preferably provided with a door 18. Shelf 10 is hingedly attached to the tub 9 by a hinge assembly generally 12. This is best seen in FIG. 3 where it will be observed that there is a recessed portion 29 defined by walls 13 and 14 having an inwardly stepped portion and end wall 15 having a ledge so provided in the side walls 15, 14 and 13 to smoothly accommodate the shelf 10 when it is in the up (back rest) position as shown in FIG. 2. The hinge assembly 12 is also located in this recessed portion 29.

It should be appreciated that the member 10 is positioned deep in the shelf cavity 11. This is seen by the fact that when it is in the upright position as shown in FIG. 2, only a small portion of the back rest area 19 extends above the top edge 20 of the side walls. This portion serves as a handle or a grab section as well as a head rest.

The shelf 10 also has an opposing seat portion 26 which is textured, continuous and contoured. This is best visualized in FIGS. 3 and 4. There it is seen that the arm rest ledges 27 and 28 provide a horizontal support surface for the shelf when it is in a seat position. These ledges 27 and 28 also afford arm rest surfaces when shelf 10 is in a back rest position.

FIGS. 5–9 are detailed views of the preferred hinge means 12. Although not shown in the drawings, it will be understood that there will preferably be two hinge assemblies 12 positioned at opposite rear and side ends of the shelf and in the recessed portion 29 as indicated by the hinge 12 in FIGS. 2 and 3. Each of the hinges 12 has a rod 31 which is connectable to the shelf 10 so that the shelf pivots as the rod rotates. This is seen in conjunction with FIGS. 10 and 11.

As seen in FIGS. 10 and 11, a pair of paddle members (one of which is represented at 66) extends from the rod 31 and is encapsulated by a foam material 67 extending between the seat portion 26 and the back rest portion 24. The rod 31 is positioned between the seat portion 26 and the back rest portion 24 by the supports 68 and 69 each having a half round section 68′ and 69′ for accommodating the rod 31. Similarly, paddle 66 is spaced between the seat portion 26 and the back rest portion 24 by the spacer feet 70 and 71. The foam material 67 is introduced between the seat portion 26 and the back rest portion 24 through two half holes (not shown) placed in each of the portions indicated by the numeral 74. Prior to the foam introduction, the paddles such as 66 and rod 31 will be positioned between the seat and back rest portions such as by the supports 68 and 69 and the spacer feet 70 and 71 and the seat portion and the back rest portions secured together by an adhesive.

Figure 9:
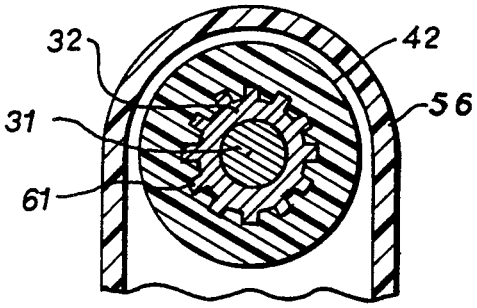
FIG. 9 is a sectional view taken along line 9—9 of FIG. 8.

Returning again to FIGS. 5–9, rod 31 is connected to an insert member 32 such as by threaded connection 34. The insert has an enlarged portion 33 against which is placed a washer 36. A bracket 38 has an opening 39 for placement over the insert 32. A first lobed cam or disk 40 is also placed over the insert 32. Both cam 40 and washer 36 are connected to the bracket 38 such as by pinning and thus are stationary. The bracket 38 in turn is connected to the ledge 28. This can be achieved by the bolts 58 and the nuts 59. A second lobed cam or disk 42 is connected to the insert 32 to rotate therewith by the splines 61, and thus moves with shelf 10. This is best seen in FIG. 9.

Lobed cam 42 is biased against cam 40 by spring 48, which is compression fitted against the washer 46 as well as washer 54. Washer 54 is in turn seated between nuts 50 and 52 which are threadably fastened on rod 31. An appropriate snap fit type cover 56 extends over the bracket 38. This is best seen by reference to FIGS. 6 and 8. There are matching and offset lobed contact surfaces 44 on the lobed cams 40 and 42 which provide a positive positioning so as to provide some resistance in movement from either the seat position such as shown in FIG. 3 or the upright back rest position such as shown in FIG. 2. This is an important feature for the shelf rest member in the downward or seat position due to the buoyancy of the water which might cause to otherwise have a tendency to float. Also, when the shelf 10 is in the up position, this prevents the back rest from falling down when bumped. The positive positioning of the lobed cams 40 and 42 into the previously described positions is illustrated by the intermediate position of cam 42 with respect to cam 40 as shown in FIG. 12 with a portion of the contact surfaces 44 separated. This illustrates the positive locking when the shelf 10 is moved to the upright back rest position or the downward or seat position and the contact surfaces 44 are fully engaged.

The hinge 12 with the lobed cams 40 and 42 is illustrated as a preferred means of holding the shelf in the upright and lowered positions. However, these advantages could be accomplished with other types of hinging mechanisms. For example, a leaf spring hinge assembly of the type now being used to hold a shower door in either an open or closed position could be used for this purpose.

Another example of a hinging mechanism is shown in the alternative embodiment generally 10A of FIGS. 13–16. Similar components are designated by similar numbers except they have an "A" suffix. Hinge 12A differs from hinge 12 in that in place of lobed cams 40 and 42, there are employed spring biased frictional washers 40A and 42A. They frictionally rotate against a stationary tang washer 55A which is connected to the fixed bracket 38A, as well as bracket 38A itself. This spring biasing frictionally provides resistance to a turning of the washers 40A and 42A and rod 31A, the washers 40A and 42A being held against rotation on the rod 31A by means of the splines 61A extending from insert 32A which is fastened to rod 31A by threads 34A. As a result, a constant frictional resistance is imparted to rod 31A and accordingly the shelf 10 at any position of the shelf. In order to assure that the shelf remains mounted in a downward position, there is provided a resilient elastomeric wedge 65A which is engaged by a front portion of the shelf 10A. Wedge 65A is composed of a 50 durometer, shore A, silicone material and has sufficient resistance to the buoyancy of water in tub to move the shelf upwardly. Wedge 65A is secured to the wall 13A by the wedge plate 66A, as well as bolts 67A and nuts 68A.

Note also that the shelf is shown in conjunction with a bathing enclosure 11 which preferably is of the whirlpool type. This is indicated by the whirlpool jet outlet 63 shown in FIG. 2. The shelf could also be used with other types of tubs (with or without the side door entrance). Importantly, note that the shelf when in the seat position permits the user to sit with most of the legs and some of the lower torso submerged. However, by a simple pivoting, it greatly expands the area of the tub, forms a smooth back rest, and even creates a raised head rest 50. All such above and other modifications within the spirit of the invention are meant to be in the scope of the invention.

We claim:

1. A tub having a combined seat and back rest assembly, said tub having an enclosure defined by side walls, a bottom wall, and an upwardly open interior cavity, at least one of said side walls being an end wall and two of said side walls adjacent thereto having ledges to provide arm rests, the assembly comprising:

a combined seat and back rest shelf which is pivotably mounted in the cavity adjacent said end wall of the cavity so that a seating surface of said combined seat and back rest shelf is contained within said cavity when said combined seat and back rest shelf is in a first position so as to form a seat;

hinging means mounting said seat and back rest shelf to said end wall, said hinging means being operatively connected to permit pivotal movement of said combined seat and back rest shelf from said first position to a second position where said combined seat and back rest shelf provides a back rest; and a recessed portion in said end wall of said tub to receive said hinging means and said shelf when the shelf is in said second position, said recessed portion being defined by two opposed peripheral walls that are stepped inwardly from the side walls on both sides of the tub and a portion of said end wall defining a ledge said hinging means being located entirely within said recessed portion in said end wall said recessed portion being of such a size so as to receive said seat and back rest shelf whereby there is provided a generally smooth back rest surface form the tub bottom up along the shelf and generally smooth side walls adjacent and immediately above the arm rests when the seat is in the second position.

2. The tub of claim 1, wherein at least half of a back rest surface of said combined seat and back rest shelf is contained within said tub when said combined seat and back rest shelf is in the second position.

3. The tub of claim 1, wherein one of said side walls has a door therein.

4. The tub of claim 1, wherein said hinging means is constructed and arranged to provide resistance against upward or downward pivoting of said shelf when it is in said first or second position.

5. The tub of claim 4 wherein said hinging means comprises a pivot stem whose movement is clamped by a spring acting against two cammed disks.

6. A tub having a combined seat and back rest assembly, said tub having an enclosure defined by side walls, a bottom wall, and an upwardly open interior cavity, at least one of said side walls being an end wall, the assembly comprising:

a combined seat and back rest shelf which is pivotably mounted in the cavity adjacent said end wall of the cavity so that a seating surface of said combined seat and back rest shelf is contained within said cavity when said combined seat and back rest shelf is in a first position so as to form a seat;

hinging means mounting said seat and back rest shelf to said end wall, said hinging means being operatively connected to permit pivotal movement of said combined seat and back rest shelf from said first position to a second position where said combined seat and back rest shelf provides a back rest, said hinging means being constructed and arranged to provide resistance against upward and downward pivoting of said shelf when it is in said first or second position, said hinging means comprising a pivot stem linked to splined washers to rotate therewith, the rotational movement of the washers and thus the pivot stem being frictionally resisted by a spring resistance forcing the splined washer 12 against a frictional bearing surface.

7. A tub having a combined seat and back rest assembly, said tub having an enclosure defined by side walls, a bottom wall, and an upwardly open interior cavity, at least one of said side walls being an end wall, the assembly comprising:

a combined seat and back rest shelf which is pivotably mounted in the cavity adjacent said one end wall of the cavity so that a seating surface of said combined seat and back rest shelf is contained within said cavity when said combined seat and back rest shelf is in a first position so as to form a seat;

hinging means mounting said seat and back rest shelf to said one end wall, said hinging means being operatively connected to permit pivotal movement of said combined seat and back rest shelf from said first position to a second position where said combined seat and back rest shelf provides a back rest, said hinging means constructed and arranged to provide resistance against upward and downward pivoting of said shelf when it is in said first or second position, said seat and back shelf being retained in said first position by a wedge member engaging a front edge portion of said seat and back rest shelf.

8. The tub of claim 7, wherein wedge member is composed of an elastomeric wedge.

* * * * *